United States Patent [19]

Shimizu et al.

[11] 4,234,365

[45] Nov. 18, 1980

[54] WEB BUTT-JOINING SYSTEM

[75] Inventors: Shigehisa Shimizu; Sanshiro Fukuhara, both of Minami-ashigara; Noboru Shinmura; Hisahiro Tanigawa, both of Yokohama, all of Japan

[73] Assignee: Fuji Photo Film Co., Ltd., Minami-ashigara, Japan

[21] Appl. No.: 974,273

[22] Filed: Dec. 28, 1978

[30] Foreign Application Priority Data

Dec. 28, 1977 [JP] Japan ..... 52/157360

[51] Int. Cl.[2] ..... B26D 5/00

[52] U.S. Cl. ..... 156/64; 156/157; 156/353; 156/504; 156/505

[58] Field of Search ..... 156/502, 504, 505, 361, 156/353, 355, 157, 159; 242/58.1, 58.3

[56] References Cited

U.S. PATENT DOCUMENTS

| | | | |
|---|---|---|---|
| 2,745,464 | 5/1956 | Auerbacher et al. | 156/504 |
| 3,317,153 | 5/1967 | Raymond | 242/58.3 |
| 3,516,617 | 6/1970 | Haner et al. | 156/361 X |
| 3,549,458 | 12/1970 | Osta | 156/505 |
| 4,067,760 | 1/1978 | Nelson | 156/505 X |

*Primary Examiner*—David A. Simmons

*Attorney, Agent, or Firm*—Sughrue, Rothwell, Mion, Zinn and Macpeak

[57] ABSTRACT

A web butt-joining system having a feeding section with rolls for feeding a pair of new and old webs, a cutting and joining section having cutting drums and joining drums, and a drive control section. The latter is composed of a driving DC motor commonly coupled to the cutting drums and joining drums. A calculation control circuit drives the DC motor and drive control section is operated to cut said new and old webs fed from said feeding section and piled one on another with said cutting drums and to butt-join the ends of said webs thus cut with bonding tapes provided on said joining drums.

19 Claims, 5 Drawing Figures

WEB BUTT-JOINING SYSTEM

BACKGROUND OF THE INVENTION

This invention relates to a system of butt-joining a flexible, belt-shaped material such as paper, plastic film or metal foil (which will be referred to as "web" hereinafter). More particularly it relates to a web butt-joining system in which electrical control is employed to butt-join webs, which are being run at high speed and with high accuracy.

Heretofore, in the case where a part of a web being fed out of a roll having the web wound on its core (the web being referred to as "an old web" hereinafter) is joined to the end of another web which will be newly fed (hereinafter referred to as "a new web"), the end portions of these new and old webs are overlaid, on one another. This method has been extensively employed. In this situation, the joined portion of the two webs is undoubtedly thicker than the remainder of the web. Therefore, when the web thus joined, for instance passes through a coating device or a printing machine, troubles due to the variation in thickness of the webs are caused in printing, coating or conveying the webs.

In order to eliminate this drawback, various techniques of butt-joining the ends of the new and old webs have been proposed. A device for practicing this method, is disclosed in U.S. Pat. Nos. 2,745,464; 3,654,035 and 3,717,057 or U.S. Pat. No. 3,939,031. Generally, such as device comprises a pair of rotatable drums for cutting the new and old webs, and a pair of or a single rotatable drum for sticking a bonding tape to the end portions of the two webs. A guide device guides the webs cut from the cutting position to the joining position. After being cut, the webs are conveyed to the joining position, and the webs are joined together with the bonding tape while being kept in an abutting relationship as the joining drum is rotated.

In general, in the web butt-joining device of this type, the cutting drums or the joining drums are driven in accordance with a mechanical driving system in which the driving power is transmitted through a clutch from the web feeding roll or its driving shaft or an electrical driving system in which DC motors coupled to the drums are employed. In the latter case, the clutch of the DC motors are operated in response to a detection signal provided when the end of the old web is detected.

In the device according to the former system, the cutting position is shifted by fluctuation of the operation of the clutch and the drum stop position is also shifted by fluctuation of the brake operation, with the lapse of time. Furthermore, the web running speed becomes different from the cutting drum circumferential speed because of the inertia of the web butt-joining device. Therefore, while the drums are being accelerated, the speed of the web feeding roll is varied. Accordingly, it is difficult to improve the web joining accuracy.

In the web butt-joining device according to the latter system, the DC motor is quickly accelerated according to the detection signal obtained when the end of the web is detected, thereby to provide speed synchronization. Since the speed synchronization is effected by speed control only, it is difficult to stop the cutting drums and the joining drums at their predetermined positions. The web is brought into contact with the drums whereby the web tends to be scratched, and speed synchronization cannot be completely obtained because the following start position is changed. If the speed synchronization is incomplete as described above, troubles such as low joining accuracy and web damage result. The degree of such difficulty is increased as the web running speed increases.

Accordingly, with the conventional device, it is difficult to cut and join the webs with high accuracy while the webs are being run at high speed, and accordingly it is necessary to decrease the speed of the entire production line or to decrease the speed of the line temporarily when the webs are joined together. This decrease of production line speed is opposite to the present tendency of increasing line speed based on remarkable technical progress in subsequent process steps.

The decrease of line speed may be prevented to an extent by providing a temporary web storing place such as a reservoir. However, as the processing speed in the subsequent processing is increased, more space is required for the temporary web storing, which results in an increase in manufacturing cost.

SUMMARY OF THE INVENTION

Accordingly, an object of this invention is to eliminate the above-described difficulties accompanying a conventional web butt-joining system.

It is another object of this invention to define a system to butt-join the webs at high speed and with high accuracy without decreasing production line speed.

These and other objects are attained by a web butt-joining system having a feeding section having rolls for feeding a pair of new and old webs and a cutting and joining section having cutting drums and joining drums. A drive control section uses a driving DC motor commonly coupled to the cutting drums and joining drums under the direction of a calculation control circuit for the driving DC motor. The drive control section is operated to cut the new and old webs fed from the feeding section with the cutting drums and to butt-join the ends of the webs thus cut with bonding tapes provided on the joining drums.

The drive control section comprises:

(a) a DC motor which is controlled by a speed control unit to simultaneously drive said cutting and joining drums through a reduction gear;

(b) a first pulse generator adapted to detect a movement length of the web to provide a pulse output thereby to obtain a value $\int \phi_A dt$;

(c) a second pulse generator adapted to detect a circumferential movement length of each of the cutting drums and joining drums to provide a pulse output thereby to obtain a value $\int \phi_B dt$;

(d) a first calculation circuit such as a cutting and joining control register in which whenever a joining instruction signal is applied thereto, a value corresponding to a length L-Co obtained by subtracting a drum circumferential length Co (from a stop position of the cutting drums to a web cutting position) from a web length L (from said web cutting position to a desired web cutting position) is inputted therein. An output of the first pulse generator is subtracted from the input value, and the subtraction result is added to an output of the second pulse generator, thereby to obtain $R = L - Co - \int \phi_A dt + \int \phi_B dt$;

(e) a first digital-to-analog converter for converting an output of the first calculation circuit into an analog voltage;

(f) a frequency-to-voltage converter for converting an output of the first pulse generator into an analog voltage;

(g) an adder for adding an output of the frequency-to-voltage converter to an output of the first digital-to-analog converter;

(h) a reference position detector which detects a reference position of the joining drums or cutting drums, and when the drums comes to a joining completion position, outputs a joining completion signal;

(i) a second calculation circuit such as a stop control register in which whenever the joining completion signal is applied thereto by the reference position detector, a value corresponding a circumferential length Co' (from the joining completion position to the stop position of said drums) predetermined is inputted thereinto, and the output of the second pulse generator is subtracted from the value thus inputted, thereby to obtain $R' = Co' - \int \phi_B dt$;

(j) a second digital-to-analog converter for converting an output of the second calculation circuit into an analog voltage; and (k) a signal selection circuit which selects an output of the adder for a period of time from reception of the joining instruction signal until reception of the joining completion signal and an output of the second digital-to-analog converter for a period of time from reception of the joining instruction signal until reception of the following joining instruction signal. It outputs a speed instruction signal for the DC motor through the speed control unit.

The invention will be described with respect to the accompanying drawings and the description of the preferred embodiment that follows.

Figure 1:
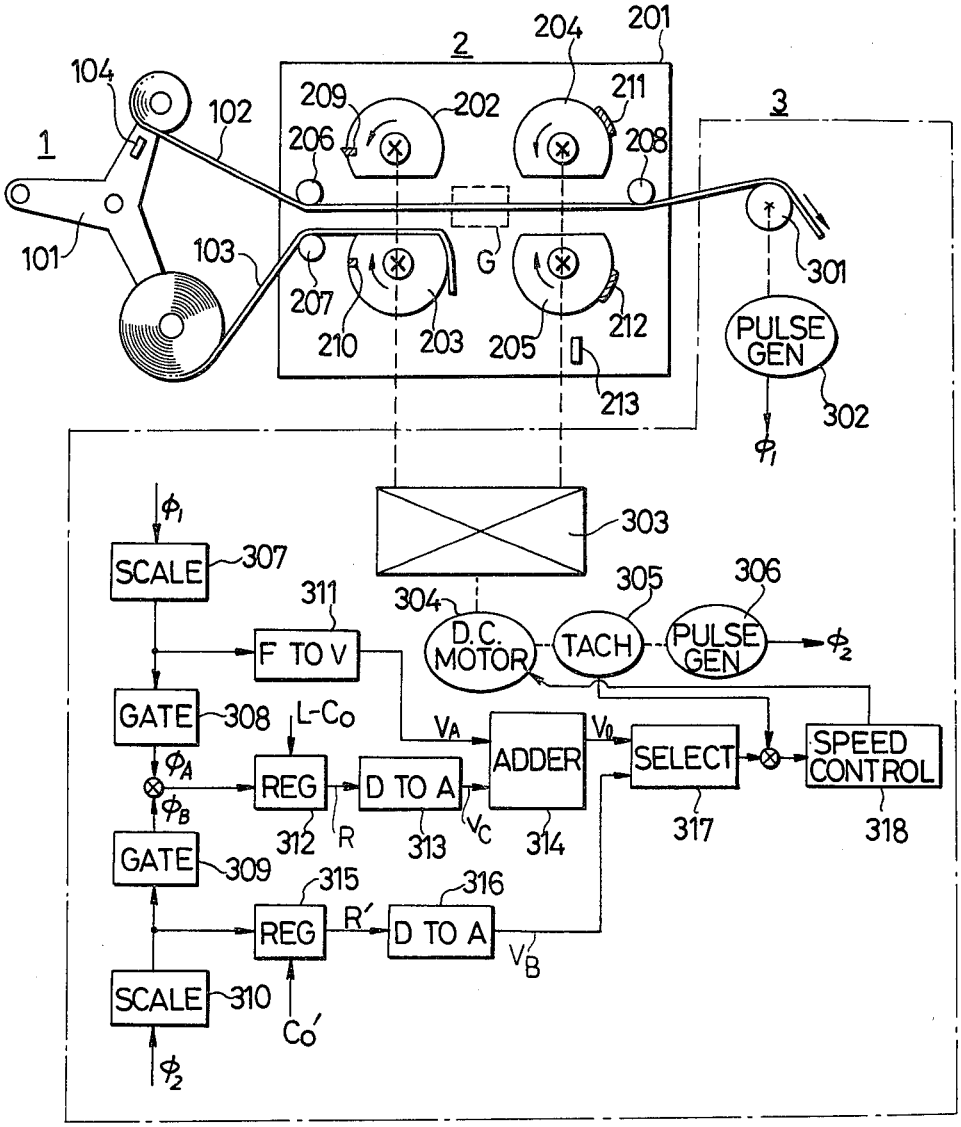
FIG. 1 is a block diagram showing one preferred embodiment of this invention.

One example of a web butt-joining device according to this invention, as shown in FIG. 1, comprises: a web feeding section 1, a web cutting and joining section 2, and a drive control section 3 of the device body.

The web feeding section 1 is made up of a three-turret system feeding device 101. The old web 102 is fed, a new web 103 is unwound, and a device such as a photoelectric detector 104 is mounted on one arm for detecting the end of the old web 102.

The web cutting and joining section 2 comprises a frame 201, a first cutting drum 202 and a second cutting drum 203 opposed to each other. A first joining drum 204 a second joining drum 205 are similarly disposed. Pass rolls 206, 207 and 208 are rotatably mounted on the frame 201. A cutting member 209 is secured to the first cutting drum 202 to simultaneously cut the webs 102 and 103. A receiving member 210 is secured to the second cutting drum 203 to cut the webs 102 and 103 in association with the cutting member 209. A web joining tape 211 is held on the first joining drum 204 and web joining tape 212 is held on the second joining drum 205. A drum reference position detector 213 has an access sensor for detecting the joining completion position of the drums 204 and 205.

The device control section 3 comprises: a web feeding roll 301 and a pulse generator 302 responsive to roll movement. A reduction gear 303 receives an output from a DC motor 304. A tachometer generator 305 delivers an output to a pulse generator 306. A scale-factor element 307 gate circuits 308 and 309; and a scale-factor element 310 supply $\phi_1$ and $\phi_2$ signals to a junction. A frequency-to-voltage converter (F/V converter) 311 receives a scaled output from element 307. A web cutting and joining control register 312 receives a summed signal and delivers on output to a digital-to-analog converter (D/A converter) 313. An adder 314 sums the outputs of D to A converter 313 and f to v converter 311. A stop control register 315 provides a signal to a D/A converter 316 which in turn is used as an input to a signal selection circuit 317, and in turn to a speed control unit 318.

FIG. 1 shows a state of the web butt-joining device in which feeding of the old web 102 will be completed soon and joining of the new web 103 is going to be effected. The old web 102 is forwarded through the pass rolls 206 and 208 for subsequent processing by the feeding roll 301, while the end portion of the new web 103 is unwound fom the turret 101. The new web is held on the second cutting drum 203 by a holding means adapted to suck and retain or hold the web.

The first and second cutting drums 202 and 203 are mounted on the frame 2 in such a manner that they pinch the web 102 therebetween. The drums 202 and 203 are rotated in the opposite directions in a revolution ratio 1:1 by gear means (not shown). While the first and second cutting drums 202 and 203 make one revolution, the cutting member 209 and the receiving member 210 cooperate to simultaneously cut the old and new webs 102 and 103 superimposed on each other.

As in the case of the web cutting drums 202 and 203, the first and second joining drums 204 and 205 are mounted on the frame 2 in such a manner that they pinch the web 102 therebetween and are rotated in the opposite direction in the revolution ratio 1:1 by gear means (not shown). The joining tapes 211 and 212 are held at predetermined positions on the peripheries of the first and second drums 204 and 205 by holding means adapted to suck and retain or hold the tapes, respectively.

Figure 2:
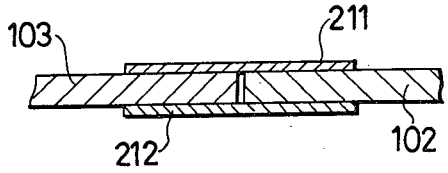
FIG. 2 is a sectional view showing one example of webs butt-joined according to the invention.

As the first and second joining drums make one revolution, the new and old webs 103 and 203 are butt-joined with the joining tapes adhering to both surfaces of the two web end portions as shown in FIG. 2. This is a sectional view of the web end portions thus butt-joined. One of the joining tapes 211 and 212 can be omitted in the case of joining a single surface.

Each of the first and second cutting drums 202 and 203 and first and second joining drums 204 and 205 is semicircular in section as shown in FIG. 1. The cutting drums 202 and 203 are arranged so that their cut surfaces (corresponding to the chords of the circles) confront the web 102, and are spaced apart from each other at the time other than the time of joining the webs, or when the drums are stopped. The joining drums 204 and 205 are similarly arranged.

A device G for guiding the new web 103 may be provided between the cutting drums 202 and 203 and the joining drums 204 and 205, if necessary. The first and second cutting drums 202 and 203 and the first and second joining drums 204 and 205 are coupled to the reduction gear 303 which is in turn coupled to the DC motor 304. That is, the four drums are accelerated or decelerated through the reduction gear 303 by the DC motor 304. The tachometer 305 connected directly to the DC motor 304 operates to feed back the rotation speed of the DC motor 304 to the speed control unit 318. The pulse generator 306 outputs the rotational angle signal of the DC motor 304 in the form of a pulse. The output signal $\phi_2$ of the pulse generator 306 is applied to the scale-factor element 310.

The feeding roll 301 is provided with the pulse generator 302 for detecting length of travel of the old web 102. The output signal $\phi_1$ of the pulse generator 302 is applied as a subtraction factor to the cutting and joining control register 312 through the scale-detector 307 and the gate circuit 308. A value L−Co is applied to the cutting and joining control register 312 by a digital switch or the like. In this connection, L is the length from the cutting position at the time of generating a termination signal of the old web 102 to a desired cutting position, and Co is the circumferential length of the first and second cutting drums 202 and 203 from the stop position thereof to the cutting position. When the old web 102 leaves the winding core of the turret 101, it is detected by the detector 104 which generates an output in the form of a joining instruction signal. As a result, the value L-Co is written in the cutting and joining control register 312. At the same time, the gate circuits 308 and 309 are opened, so that the input signals $\phi_1$ and $\phi_2$ respectively from the scale-factor elements 307 and 310 are applied as a subtraction input and an addition input to the cutting and joining control register 312.

The scale-factor element 307 is made up of a circuit which can change the factor so that, when the web runs one meter for instance, 10,000 pulses are provided. The scale-factor element 310 is so set that its output is equal to the output of the scale-factor element 307 in correspondence to the amount of movement in circumferential length of the first and second cutting drums 202 and 203. If the output value of the cutting and joining control register 312 after detection of the end of the old web 102 is represented by R, then, $$R=L-Co-\int\phi_A dt+\int\phi_B dt$$

where, $\phi_A$ is the number of pulses per unitary time applied by the scale-factor element 307 and $\phi_B$ is the number of pulses per unitary time applied by the scale-factor element 310.

The D/A converter 313 operates to convert the value R of the cutting and joining control register 312 into a DC voltage. The output voltage Vc of the D/A converter 313 is positive when the value R is positive, and the voltage Vc is negative when the value R is negative. The voltage Vc together with a negative voltage $V_A$ proportional to a web running speed and obtained through the scale-factor element 307 and the F/V converter 311 is applied to the adder 314.

In the adder 314, the aforementioned voltage's polarity are changed. The output Vo of the adder 314 is applied to the signal selection circuit 317. A DC voltage value $V_B$ obtained by subjecting the output R′ of the stop control register 315 (described later) to D/A conversion by the D/A converter 316 is also applied to the signal selection circuit 317. There, the voltage Vo is selected for the period of time from the start of revolution of the drums until the completion of joining, and the voltage $V_B$ is selected for the period of time from the completing of joining until the next revolution of the drums.

A value Co′ representative of the circumferential length, from the joining completion position to the stop position, of each drum is an input into the stop control register 315 with the aid of the joining completion signal from the reference position detector 213.

The pulses from the scale-factor element 310 are applied to the stop control register 315 to perform subtraction when the drums forwardly rotate and to perform addition when the drums are reversely rotated. If the value stored in the stop control register 315 is represented by R′, then the following equation is obtained:

$$R'=Co'-\int\phi_B dt$$

The speed control unit 318 is capable of applying forward and reverse currents to the armature of the D.C. motor 304. It incorporates a thyristor bridge, a speed error amplifier, and a high speed responsive thyristor phase shifter of conventional design.

The control operation of the web butt-joining device shown in FIG. 1 will now be described.

Upon reception of the joining instruction signal from the web end detector 104, the cutting and joining control register 312 stores the value L-Co. The value L is much larger than the value Co. Thereafter, the value in the register 312 becomes $R=L-Co-\int\phi_A dt+\int\phi_B dt$ as described before. The value R is decreased as the web runs. On the other hand, the values $-V_A$ and $-V_C$ are changed to positive, starting to accelerate the DC motor 304. Since the increment of $\int\phi_B dt$ is greater than $\int\phi_A dt$, they become signals to rotate the motor at high speed.

When $\phi_A$ equals $\phi_B$, R is not changed, and the web running speed becomes equal to the drum circumferential speed. Furthermore, because the speed control unit 318 is adjusted so that the web running speed coincides substantially with the drum circumferential speed with the aid of only the signal $-V_A$, the signal $V_C$ being zero, the cutting and joining operation is carried out with the value R being substantially zero. If the power of the DC motor 304, the rotational radius of each drum, the reduction gear 303, and the input gain of the D/A converter 313 are suitably designed, the cutting can be achieved after the value of R becomes zero. The fact that R is zero means $L-Co-\int\phi_A dt+\int\phi_B dt=0$. At the same time of cutting, $L-\int\phi_A dt=0$ because $Co=\int\phi_B dt$, and therefore the cutting is effected when the web feeding length $\int\phi_A dt$ becomes L. The drums are rotated under the conditions that R=0 and follows accordingly $V_C=0$ after the completion of cutting, because servo control is carried out in which when the speed of each drum is increased and $\phi_B$ becomes greater than $\phi_{A'to}$ R becomes positive to decrease the drum signal and $\phi_B$ is decreased to decrease R to zero again. Thus, joining of the new and old webs 103 and 102 is carried out with the rotation speed of each drum following the running speed of the old web 102.

Upon application of the joining completion signal, a signal Co′ is provided to the stop control register 315, and therefore R′ becomes equal to $Co'-\int\phi_B dt$. The signal selection circuit 317 selects the value $V_B$ obtained by subjecting R′ to D/A conversion and $Co'-\int\phi_B dt$ is decreased. As the value $V_B$ decreases, the speed of each drum is decreased. When the value $V_B$ becomes zero, each drum is stopped at the stop position advanced as much as Co′ from the joining completion position. The value $V_B$ is limited so that it may not become greater than the value $V_A$ and fluctuation at the time of switching the signals is prevented, although such a mechanism is not shown in FIG. 1.

As is apparent from the above description, this invention has the following significant effects:

(1) The web cutting is carried out when the web running speed coincides completely with the cutting drum circumferential speed, that is, the speed difference therebetween is zero. Therefore, web cutting accuracy is improved, and no bad influences such as tension variation are given to the web.

(2) The web cutting is carried out when the web running speed coincides completely with the cutting drum circumferential speed, that is, the speed difference therebetween is zero. Therefore, similarly, no tension variation is caused, and the joining ends of the new and old webs and the joining tapes meet one another, i.e., the ends of the webs can be butt-joined completely.

(3) Because the cutting drums and the joining drums are restored to their predetermined positions after cutting and joining, the web is protected from being brought into contact with the drums. This prevents the web from being scratched by such contact, and the cutting and joining accuracy is not degraded even if the joining operation is repeatedly carried out.

(4) The web cutting and joining operation is achieved at high speed (in a short time). Therefore, production line speed is not decreased. Since the old web can be cut and joined at a desired position, loss of the web can be decreased, and potentially serious trouble such as the passage of the web before it is joined can be prevented.

While the present invention has been described with reference to its preferred embodiment, it should be noted that the invention is not limited thereto or thereby. That is, it will be apparent to those skilled in the art that various changes and modifications may be made therein without departing from the spirit of the invention.

For example, (a) The total number of the web cutting and joining drums is not always limited to four. If one of the cutting drums 202 and 203 is combined with one of the joining drums 204 and 205 to form a cutting and joining drum, then the same effect can be obtained with three drums. In the embodiment described above, the drums are coupled through the reduction gear 303 to the DC motor 304, however, in the case where a mechanically sufficient design is provided and it is unnecessary to change the line speed and the joining speed, the reduction gear can be eliminated.

(b) In the above-described embodiment, the joining instruction signal is provided by the web end detector 104. However, the joining instruction signal may be obtained from detecting the winding diameter of the old web 102, the length of web fed out, or the revolution number of the web feeding shaft. In the case of a manual operation, the joining instruction signal may be obtained from an operating button actuated by the operator according to his judgment.

(c) The feed roll 301 is used as a means to detect the web position in the above-described embodiment however, it may be replaced by a measuring roll which is coupled to the pulse generator 302.

(d) The scale-factor element 307 capable of changing the factor so that the pulse generator 306 adapted to detect the rotational angle of the DC motor 304 (that is, the drum rotational angle) outputs 10,000 pulses when the web runs one meter is employed in the above-described embodiment. However, if the web cutting and joining device is designed to meet this requirement in advance the scale-factor element 307 may be omitted.

(e) In the above-described embodiment, the joining completion signal is outputted by the drum reference position detector 213 when the joining drum shaft is at the joining completion position. The web butt-joining device may be designed so that the output pulses of the pulse generator 306 for detecting the drum rotational angle are counted with a reference position of the drum as zero. When the number of output pulses becomes equal to the number of pulses corresponding to the distance up to the joining completion position, the joining completion signal is outputted.

(f) The pulse generator 306 may be coupled directly to the drum.

(g) The tachometer generator 305 for detecting the speed of the DC generator 304 may be substituted by subjecting the output of the pulse generator to frequency-to-voltage conversion.

(h) In the above-described embodiment, the gate circuits 308 and 309 are opened upon reception of the joining instruction signal to pass the outputs of the first and second pulse generators 302 and 306, and are closed when the DC motor 304 is stopped to block the passage of the outputs of the first and second pulse generators 302 and 306. However, in the case where high waveform processing accuracy is not required (or the reliability in joining accuracy is not strictly required), the gate circuits may be eliminated and instead the signal selection circuit 317 may be substituted for the gate circuits.

Figure 3:
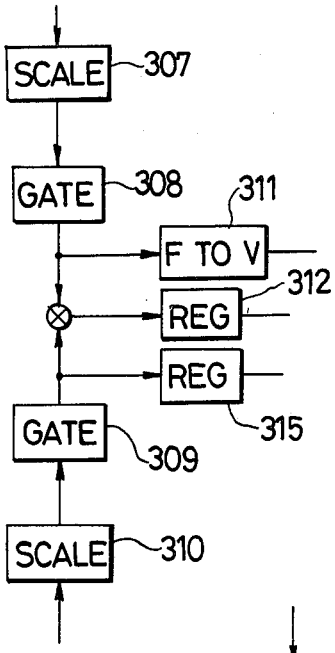
FIGS. 3 through 5 are block diagrams showing modifications of a part of a circuit shown in FIG. 1.

(i) If the gate circuits 308 and 309 are modified as shown in FIG. 3, then the gate circuits may be rendered conductive (ON) by the joining instruction signal, the gate circuit 308 may be rendered non-conductive (OFF) by the joining completion signal. The gate circuit 309 may be rendered non-conductive by the stop signal of the DC motor 304.

In this case, it is unnecessary to stop the DC motor 304 at the stop position at all times, and the DC motor 304 can be mechanically stopped by a brake (not shown) additionally provided. Therefore, it is unnecessary to energize the motor at all times even if the operation lasts for a long time, which contributes to the economization of energy and to an improvement in work safety.

Figure 4:
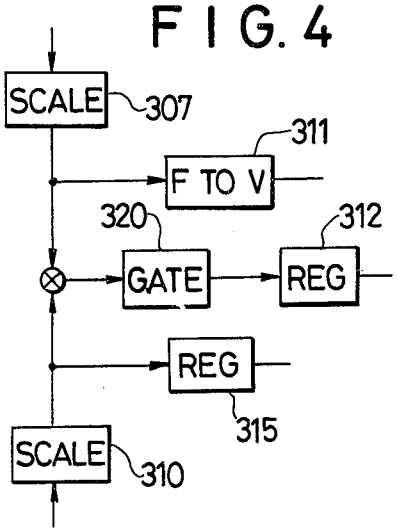

(j) The gate circuits 308 and 309 may be combined into one unit 320 as shown in FIG. 4, which is turned on by the joining instruction signal and off by the joining completion signal. This will contribute to the simplification of the device.

Figure 5:
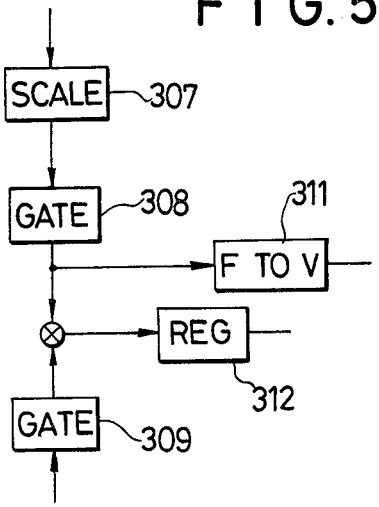

(k) If the position of the gate circuit 308 is changed so that its output is applied to the F/V converter 311 as shown in FIG. 5, then the reliablity in joining can be improved. Also, in this situation, application of the input to the adder 314 when not required can be prevented. Similarly as in paragraph (i) above, the gate circuit 308 is designed so that it is turned on by the joining instruction signal and off by the joining completion signal.

As is clear from the above description, this invention has significant merits that the webs can be butt-joined at high speed and with high accuracy without decreasing the line speed of the web.

We claim:

1. A method of butt-joining comprising the steps of:
feeding a pair of webs to be joined into a cutting and joining section having cutting and joining drums operable by the selective driving of a D.C. motor,
overlapping and cutting said pair of webs on said cutting drums,
butting and joining the ends of said cut webs,
controlling the rotational speed of said D.C. motor during said cutting and joining steps in response to a signal indicating both the web running speed and the relative positions between the drums and webs such that the running speed of said webs corresponds to the circumferential speed of said cutting and joining drums during the cutting and joining steps, and
stopping said cutting and joining drums at predetermined positions following completion of the cutting and joining steps.

2. The method of claim 1 wherein said step of controlling the rotational speed of said D.C. motor comprises the steps of, generating a signal corresponding to a desired web length, generating a number of first pulses corresponding to web movement, generating a number of second pulses corresponding to circumferential length movement of each of said cutting and joining drums, calculating as one web is moved the value to obtain coincidence between web position and drum rotational position, and combining said value with a web running speed value to control said motor.

3. The method of claims 1 or 2 wherein said step of controlling the rotation speed of said D.C. motor includes the further steps of generating a number of pulses after completion of web cutting and joining corresponding to circumferential drum length to a stop position and calculating to provide an output signal to stop each drum.

4. The method of claim 2 wherein said desired web length corresponds to L-Co where, L is the web length from a web cutting position to a desired web cutting position and Co is the circumferential length of each cutting drum from a stop position of said cutting drum to the web cutting position.

5. The method of claim 4 wherein the step of generating a number of first and second pulses corresponding to web movement and circumferential length movement defines $\int \phi A dt$ and $\int \phi B dt$, wherein $\phi_A$ are pulses indicative of unit length movements of said web and $\phi_B$ are pulses indicative of corresponding unitary lengths of circumferential drum travel.

6. The method of claim 5 wherein the step of calculating a value to obtain comprises the step of calculating $R=L-Co-\int \phi_A dt+\int \phi_B dt$.

7. The method of claim 6 further comprising the step of converting R into a D.C. voltage and combining said D.C. voltage indicative of web running speed.

8. A method of web butt-joining comprising the steps of feeding a pair of new and old webs from a feeding section having rolls to a cutting and joining section having cutting drums and joining drums; controlling a DC motor coupled commonly to the cutting drums and joining drums by a calculation control circuit for said driving DC motor; cutting said new and old webs fed from said feeding section and overlapping one on another with said cutting drums; and butt-joining the ends of said webs thus cut with bonding tapes provided on said joining drums; wherein the step of controlling a D.C. motor includes are steps of, generating a number of pulses corresponding to a length L-Co where L is the web length from a web cutting position to a desired web cutting position and Co is the circumferential length of each cutting drum from a stop position of said cutting drum to the web cutting position, generating a number of first pulses corresponding to web movement and a number of second pulses corresponding to a circumferential movement length of each of said cutting and joining drums to obtain $\int \phi_A dt$ and $\int \phi_B dt$, respectively, wherein $\phi_A$ are pulses indicative of unit length movements of said web and $\phi_B$ are pulses indicative of corresponding unitary lengths of circumferential drum travel calculating an output value $R=L-Co-\int \phi_A dt+\int \phi_B dt$ as said old web is forwarded, converting said output value R into a positive or negative DC voltage value and adding to a DC voltage corresponding to a web running speed to obtain a sum so that said drums are rotated according to said sum, generating after completion of web cutting and joining operations a number of pulses Co' corresponding to a circumferential length of each drum from a joining completion position thereof to a stop position thereof and a number of pulses $\int \phi_B dt$ corresponding to a circumferential movement length of each drum when rotated forwardly, calculating $R'=Co'-\int \phi_B dt$ and converting into a DC voltage signal to stop each drum at a stop position thereof, whereby when the web running speed coincides with the circumferential speed of said cutting drums such that the difference therebetween is zero, web cutting is carried out, and when the web running speed coincides with the circumferential speed of said joining drum such that the difference therebetween is zero, web joining is carried out, and that after completion of the cutting and joining operations said cutting drums and said joining drums are restored to predetermined positions thereof and stopped.

9. A web butt-joining system comprising:
a feeding section having rolls for feeding a pair of new and old webs, a cutting and joining section having cutting drums and joining drums, a drive control section having a driving D.C. motor commonly coupled to said cutting drums and joining drums and a calculation control circuit for selectively controlling said driving D.C. motor in response to signals indicative of both the running speed of said old web and the positional relationship between said old web and said cutting and joining drums, said drive control section being operated to cut said new and old webs fed from said feeding section with said cutting drums and to butt-join the ends of said webs thus cut with bonding tapes provided on said joining drums.

10. The system of claim 9 wherein said drive control section further includes a speed control unit whereby said DC motor is controlled by speed control unit to simultaneously drive said cutting and joining drums through a reduction gear.

11. The system of claim 9 wherein said drive control section further comprises a first pulse generator adapted to detect a movement length of said web to provide a pulse output to obtain a value $\int \phi_A dt$ and a second pulse generator adapted to detect a circumferential movement length of each of said cutting drums and joining drums to provide a pulse output thereby to obtain a value $\int \phi_B dt$ wherein $\phi_A$ are pulses indicative of unit length movements of said web and $\phi_B$ are pulses indicative of corresponding unitary lengths of circumferential drum travel.

12. The system of claim 11 wherein said calculation control circuit comprises first calculation circuit wherein a value corresponding to a length L−Co is obtained by subtracting a drum circumferential length Co from a stop position of said cutting drums to a web cutting position from a web length L from said web cutting position to a desired web cutting position, an output of said first pulse generator is subtracted from said value thus obtained, and the subtraction result is added to an output of said second pulse generator, thereby to obtain $R=L-Co-\int\phi_A dt+\int\phi_B dt$.

13. The system of claim 12 further comprising a first digital-to-analog converter for converting an output of said first calculation circuit into an analog voltage.

14. The system of claim 13 further comprising a frequency-to-voltage converter for converting an output of said first pulse generator into an analog-voltage.

15. The system of claim 14 further comprising an adder for adding an output of said frequency-to-voltage converter to an output of said first digital-to-analog converter.

16. The system of claims 11 or 15 further comprising reference position detector means for detecting a reference position of said joining drums or cutting drums, and when said drums come to a joining completion position, outputting a joining completion signal.

17. The system of claim 16 where said calculating control circuit further comprises second calculation circuit means which, whenever the joining completion signal is applied thereto by said reference position detector, a value corresponding to a predetermined circumferential length Co′ from the joining completion position to the stop position of said drums is inputted thereinto, and the output of said second pulse generator is subtracted from said value thus inputted, thereby to obtain $R'=Co'-\int\phi_B dt$.

18. The system of claim 17 further comprising second digital-to-analog converter for converting an output of said second calculation circuit means into an analog voltage.

19. The system of claim 18 further comprising a signal selection circuit which selects an output of said adder for a period of time from reception of said joining instruction signal until reception of said joining completion signal and an output of said second digital-to-analog converter for a period of time from reception of said joining instruction signal until reception of the following joining instruction signal, and outputs a speed instruction signal for said DC motor through said speed control unit.

* * * * *